United States Patent [19]
Genz
[11] 4,256,358
[45] Mar. 17, 1981

[54] WIRE ENGAGEMENT AND RELEASE ARRANGEMENT

[75] Inventor: Earl J. Genz, Des Plaines, Ill.
[73] Assignee: Illinois Tool Works Inc., Chicago, Ill.

[21] Appl. No.: 99,391
[22] Filed: Dec. 3, 1979
[51] Int. Cl.³ ..... H01R 11/22; H01H 5/22
[52] U.S. Cl. ..... 339/95 D; 200/284
[58] Field of Search ..... 200/61.86, 284; 339/95 D, 53, 252 R

[56] References Cited

U.S. PATENT DOCUMENTS

| | | | |
|---|---|---|---|
| 1,704,625 | 3/1929 | Nero . | |
| 2,705,785 | 4/1955 | Benander | 339/252 R |
| 2,779,828 | 1/1957 | Despard . | |
| 2,813,158 | 11/1957 | Hutt | 200/6 |
| 2,841,673 | 7/1958 | Benander | 200/166 |
| 2,946,036 | 7/1960 | Bettencourt | 339/95 |
| 3,030,479 | 4/1962 | Ehrlich . | |
| 3,060,399 | 10/1962 | Pistey | 339/53 |
| 3,099,505 | 7/1963 | Schwartz | 339/95 |
| 3,120,589 | 2/1964 | Westburg | 200/61.86 |
| 3,165,614 | 1/1965 | Carissimi . | |
| 3,206,710 | 9/1965 | McLaughlin | 339/95 |
| 3,474,389 | 10/1969 | Nagano | 339/95 |
| 3,502,835 | 3/1970 | Batcheller | 200/154 |
| 3,569,911 | 3/1971 | Bogdanowicz | 339/95 |
| 3,617,674 | 11/1971 | Osika . | |
| 3,646,582 | 2/1972 | Van Alphen | 339/95 D |
| 3,748,419 | 7/1973 | Torrey | 200/155 R |
| 3,808,581 | 4/1974 | Murray | 339/95 D |
| 3,932,012 | 1/1976 | Reimer | 339/95 B X |
| 3,936,126 | 2/1976 | Miller | 339/95 D |
| 4,133,594 | 1/1979 | Laverick | 339/95 D |

*Primary Examiner*—John McQuade
*Assistant Examiner*—John S. Brown
*Attorney, Agent, or Firm*—Thomas W. Buckman; Glenn W. Bowen

[57] ABSTRACT

The present invention relates to a wire engagement and release arrangement for electrical switches, and the like, wherein the wire engagement arrangement consists of an electrical contact which is bifurcated to form two flat spring arms, one of which is shorter than the other. A pair of individual passageways through the housing of the device to be wired are provided for receiving the bare end of an electrical wire of a pair of insulated wires which are inserted into the passageways so as to pass therethrough against the ends of the spring arms whereby the spring arms will deflect and will force the bare ends of these wires against the housing walls of the electrical device. The ends of the spring arms are provided with widened portions which allow the force on the bare ends of the wire to be applied over a larger area. The release arrangement is provided by a pair of elongated apertures which extend through parallel surfaces of the housing that are aligned normal to the side dimension of the flat spring arms. The elongated apertures are offset from each other and are positioned so that their elongated axes are not substantially normal to their adjacent spring arm. The connecting wires may thus be released individually from the spring arms by movement of a pin in the elongated aperture. The aperture is dimensioned so that the spring arm cannot be deflected far enough to overstress it, and thereby cause it to take a set.

7 Claims, 7 Drawing Figures

WIRE ENGAGEMENT AND RELEASE ARRANGEMENT

BACKGROUND OF THE INVENTION

The present invention relates to wiring devices of the type in which a single contact is divided into a pair of bifurcated spring arms, one of which is longer than the other. This arrangement provides for the interconnection of two electrical wires to a common electrical point through the spring arms. The wires are commonly inserted through apertures in the housing of the device and the spring arms are biased so that they engage the bare end of the connecting wires and force them against housing walls of the device that is being wired. A commonly used arrangement for releasing the wires from engagement with the spring arms is to provide a channel or passageway at the bottom of the electrical switch or other device so that when an elongated pin is inserted through the channel the end of the pin will engage the contact and will deflect it upwardly so that wires may be released. The insertion of a pin into such a channel, for example, as shown in the E. J. McLaughlin, U.S. Pat. No. 3,206,710, however commonly cause both of the wires to be disconnected from the spring arms simultaneously since the pin engaged the contact at a point where the two spring arms had not yet diverged from the main body of the contact.

It is often faster and, therefore, more cost effective, however, in the wiring, trouble shooting and inspection of electrical switches and other devices using the aforementioned type of multiple wire connections to be able to individually disconnect each of the wires of a wire pair. Prior art construction of devices such as those shown in the McLaughlin patent and the K. J. Batcheller, U.S. Pat. No. 3,502,835 did not provide such a feature. In the present invention, however, the wires of each pair of wires can be individually released so that when it is desired to have only one wire connected to the contact, it is unnecessary for the serviceman to release both of the wires and then reinsert one of them. The fast disconnect arrangement of the present invention is provided by a pair of offset elongated apertures through parallel housing surfaces of the electrical switch, or other electrical device.

DESCRIPTION OF THE DRAWINGS

The present invention is described by reference to the drawings in which.

TECHNICAL DESCRIPTION OF THE INVENTION

The wire engagement and release arrangement of the present invention is shown and described herein in conjunction with a gas ignition switch. This wiring arrangement, however, may be used with other electrical devices including lamp holders or other types of switches; and in general, it may be used whereever it is desirable to interconnect a pair of electrical wires which have a bare terminal end together through a common bifurcated spring contact member.

Figure 1:
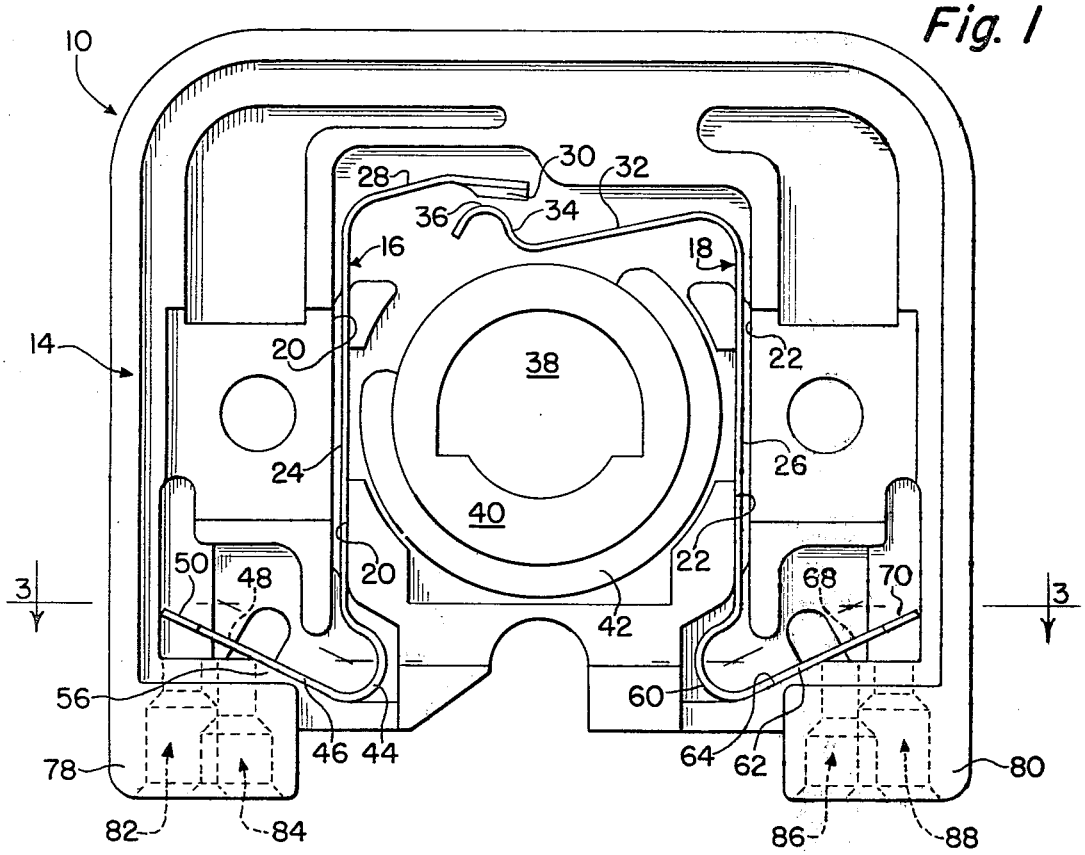
FIG. 1 is a side view of an electrical switch with the cover removed which incorporates the wiring engagement and release arrangement of the present invention.

The gas ignition switch 10, shown in FIG. 1, has its cover removed to better illustrate the components of the invention. The housing 14 of the gas ignition switch supports a pair of flat contacts 16, 18, which are made of a conductive, springable material, in a fixed relationship in the housing. The housing itself is formed of plastic or other suitable electrical insulating material. The elongated contacts 16, 18 are supported in grooves 20, 22. The sides of which engage straight elongated segments 24, 26 of the contacts. The upper portion 28 of the contact 16 is bent inwardly from the elongated intermediate section 24 and carries a contact area 30 at its end. The upper portion 32 of the contact 18 is similarly bent inwardly from its elongated intermediate section 26 towards the contact area 30. As the portion 32 approaches the contact area 30, however, it slopes downwardly and has a "S" bend 34 at its inner end so that the curved segment 36 engages the contact area 30.

In operation, the gas ignition switch of FIG. 1 is supported by a gas valve, the shaft of which projects through the large central aperture 38. The cam 40 that surrounds the aperture is thus locked onto the gas valve and rotates with it as it is turned. The cam 40 has a high area 42 which extends around a substantial portion of the periphery of the cam 40 so that when the shaft of the valve is rotated sufficiently far enough the high area 42 forces the segment 36 of the contact 18 upwardly so that it engages the contact area 30 of the contact 16 thereby closing the electrical circuit. The described electrical gas ignition switch has construction features which are similar to those shown in the William Edward Ward, U.S. Pat. No. 3,971,904, which show some of these features in greater detail.

The lower portion of the contacts 16, 18 form the wire engagement arrangement of the present invention. The lower portion of the contact 16 has a reverse bend 44 formed in it so that the lower, straight end 46 of the arm 50 is forced against the ramp area 56 that is formed in the lower portion of the housing 14, and the ends of the spring arms 48, 50 are spring biased toward the housing walls 52, 54. The contact member 18 is formed with a similar reverse bend 60 so that the lower elongated portion 62 of the arm 70 is forced against the ramp area 64 and the ends of the spring arms 68, 70 are spring biased towards the housing walls 52, 54 so as to clamp the bare ends of the wires that are inserted into the device therebetween.

Figure 2:
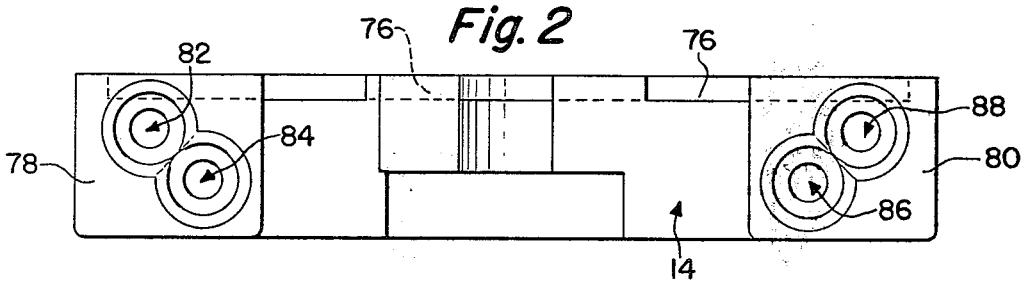
FIG. 2 is an end view of the switch of FIG. 1 with the cover in place.
Figure 5:
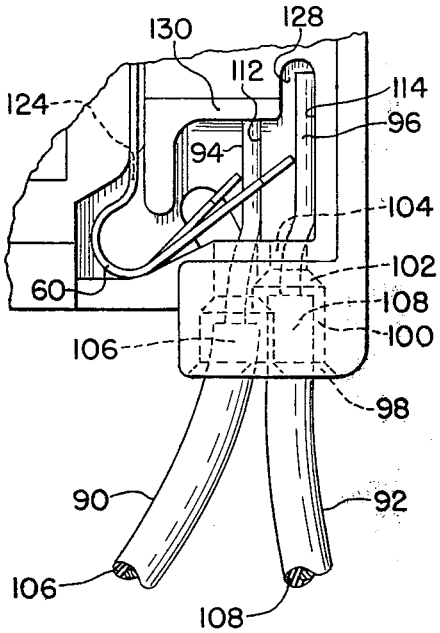
FIG. 5 is a partial side view of the switch of FIG. 1 with a pair of wires inserted into the switch in engagement with the spring arms.
Figure 6:
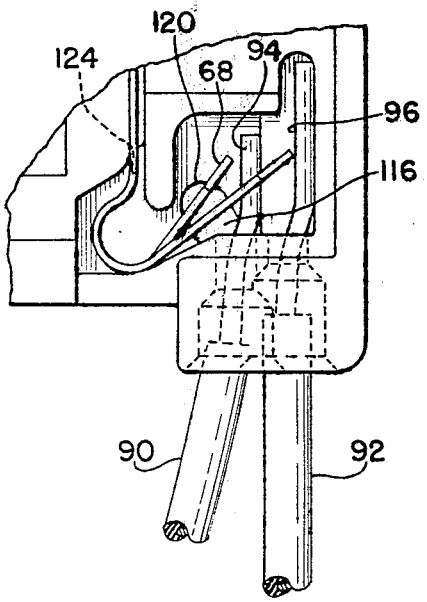
FIG. 6 is a partial side view of the switch of FIG. 1 which shows the shorter one of the spring arms being released from its engaging wire.

The lower part of the housing 14 which is shown in FIGS. 1 and 2 is substantially thinner than the cover 76 which serves merely to enclose the housing. The cover 76 and the housing 14 thus form a pair of parallel housing surfaces that run substantially normal to the wide dimension of the flat spring arms. The housing 14 has a pair of enlarged blocks 78, 80 which are provided with passageways 82, 84 and 86, 88, respectively, that allow for the easy insertion of electrical insulated wires such as the wires 90, 92 that are shown in FIG. 5. The wires 90, 92 have bare ends 94, 96 that are inserted well into the interior of the switch. Each wire is inserted into an opening in the blocks 78, 80 which is constructed so as to have a bevelled inlet 98 of decreasing diameter so that the wire may be easily inserted into the opening. The inlet 98 leads to a first constant diameter section 100 which extends to a second inlet 102 of decreasing diameter. The bevelled inlet 102 leads to a smaller constant diameter section 104 which communicates with the interior of the housing 14. Thus, as shown in FIG. 5, the insulated bodies 106, 108 of the wires 90, 92 extend into the constant diameter sections 100, but preferably the reduced diameter section 104 will be of a small enough diamter to restrict the associated insulated body from projecting beyond this point, but at the same time, will be large enough to allow the bare end of the wire, such as the ends 94, 96, to pass therethrough. By providing separate openings 82, 84 and 86, 88 for each wire that is connected to the electrical switch of the described embodiment, the fast insertion and removal of each wire in an individual manner is thereby facilitated.

Figure 3:
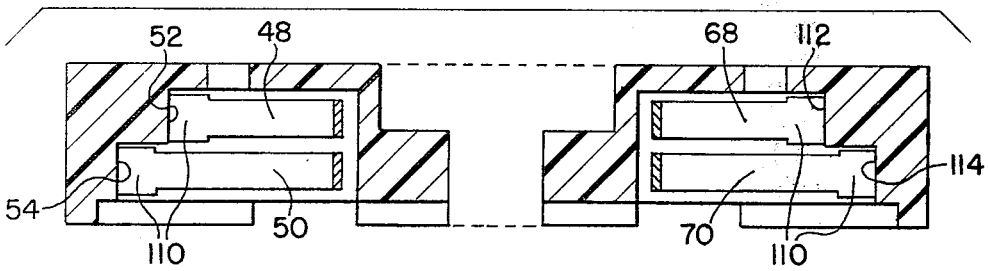
FIG. 3 is a cross-sectional view taken along the lines 3—3 of FIG. 1 which shows the shape of the flat spring arms.

As shown in FIG. 3, the spring arms 48, 50, 68 and 70 are all formed with widened ends 110. These widened ends provide a greater contact area with the bare ends of the inserted wires and thus an increased gripping force. FIG. 5 shows the same section of the switch as FIG. 4 but with the wires 90, 92 inserted into the switch. The wires 90, 92 are inserted sufficiently far so that the bare ends 94, 96 are forced past the widened ends 110 of the spring arms 68 and 70 as these arms are deflected upwardly whereby the ends 110 of the spring arms 68, 70 act to force the bare ends 94, 96 against the housing walls 112, 114.

Figure 4:
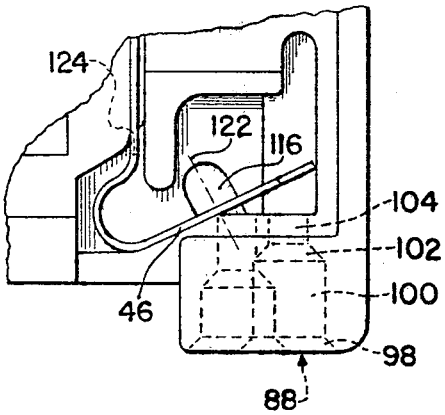
FIG. 4 is a partial side view similar to that of FIG. 1 but with only the right-hand spring arm portion of the switch being shown with no wires inserted.
Figure 7:
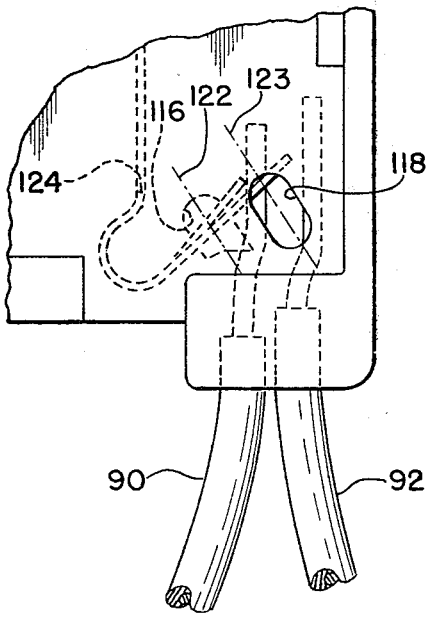
FIG. 7 is a partial side view of the switch of FIG. 1, but with the cover added, which shows the longer one of the spring arms being released from its engagement wire.

In order to provide for fast disconnect of a single wire, a pair of offset elongated apertures 116 and 118 are formed in the housing 14 and in the cover 76, as best shown in FIG. 7. A similar pair of elongated apertures also will be provided, of course, in a corresponding position in the housing and the cover with respect to the contact arms 48, 50. The elongated aperture 116 in the housing 14 is utilized to release the spring arm 68 from the bare end 94 of the wire 90 by the insertion of a pin (not shown) in the elongated aperture 116 and by forcing the pin upwardly toward the curved end 120 of the aperture 116. In addition to having curved ends, the aperture 116 has an elongated axis 122 which is substantially normal to the spring arm 68 of the contact 16 when a wire is not inserted into the switch. The spring arms of each contact, for example, the arms 68, 70, are preferably separated from the main body of the corresponding contact, such as the contact 18, by a slot that extends from the ends 110 all the way around the reverse bend 60 to a point 124, as shown in FIG. 4, in order to give them a relatively large amount of individual flexibility.

In a similar manner, the elongated aperture 118 in the cover 76 has an elongated axis 123 which is substantially normal to the spring arm 70 when a wire is not inserted into the switch. Both of the elongated apertures are dimensioned so that the wires 90, 92 may be released individually from engagement with the arms 68, 70 without overstressing the spring arms, thereby giving them a set. When the bare end 96 of the wire 92 is inserted into the housing, it is limited by the end of the recess 128 while the end of the wire 94 is limited by the ledge 130 that is formed on the housing 14.

What is claimed is:

1. A wire engagement and release arrangement for an electrically operated device comprising a housing having a pair of substantially parallel housing surfaces, a pair of closely spaced wire openings through said housing, each of which is dimensioned so as to allow for the insertion of an electrical wire having a bare end therein, housing walls adjacent to said wire openings, a flat bifurcated spring contact member secured in said housing and having a pair of spring arms which are positioned so that their wide dimension runs substantially normal to said parallel surfaces, said contact member having a bend therein which provides a spring bias to said spring arms, said housing having an area against which said spring arms are biased, one of said spring arms being longer than the other of said spring arms and the ends of said spring arms being located relative to said wire openings so that when said bare ends of said electrical wires are inserted into said wire openings they will engage said spring arms causing them to deflect and thereby force said bare ends against said housing walls thereby clamping said bare ends between said spring arms and said housing walls, and wire release means comprising a first elongated aperture located in one of said parallel housing surfaces and having an elongated axis which is substantially normal to the shorter of said spring arms when said wires are not inserted into said electrical device and a second elongated aperture which is opposite from said first aperture in the second of said parallel housing surfaces which has an elongated axis which is substantially normal to the longer of said spring arms when said wires are not inserted into said electrical device.

2. A wire engagement and release arrangement, as claimed in claim 1, wherein said elongated apertures are dimensioned so that when said spring arms are released from engagement with their associated wires by means of a pin inserted into the associated elongated aperture, the associated spring arm will not be overstressed to the point of taking a set.

3. A wire engagement and release arrangement, as claimed in claim 1, wherein said spring arms have a widened end portion which increases the surface contact area of said spring arms with the bare ends of their associated electrical wire.

4. A wire engagement and release arrangement, as claimed in claim 3, wherein said elongated apertures are dimensioned so that when said spring arms are released from engagement with their associated wires by means of a pin inserted into the associated elongated aperture, the associated spring arm will not be overstressed to the point of taking a set.

5. A wire engagement and release arrangement, as claimed in claim 1, wherein said wire openings are constructed to have a first inlet for receiving an associated electrical wire therein, a first substantially constant diameter section which receives the insulated body of the electrical wire that is inserted therein, a second inlet of decreasing diameter and a second substantially constant diameter section which is of a smaller diameter than said first diameter section and is dimensioned so that the insulated body of said electrical wire will not project into said second diameter section but so that said bare end of said electrical wire will project through said second diameter section into the interior of said housing.

6. A wire engagement and release arrangement, as claimed in claim 5, wherein said elongated apertures are dimensioned so that when said spring arms are released from engagement with their associated wires by means of a pin inserted into the associated elongated aperture, the associated spring arm will not be overstressed to the point of taking a set.

7. A wire engagement and release arrangement, as claimed in claim 6, wherein said spring arms have a widened end portion which increases the surface contact area of said spring arms with the bare ends of their associated electrical wire.

* * * * *